US010749285B2

(12) United States Patent
Kawamura et al.

(10) Patent No.: US 10,749,285 B2
(45) Date of Patent: Aug. 18, 2020

(54) O-RING, O-RING LOCK STRUCTURE, TERMINAL BLOCK, AND VEHICULAR DEVICE

(71) Applicant: Yazaki Corporation, Tokyo (JP)

(72) Inventors: Yukihiro Kawamura, Makinohara (JP); Naoki Isaka, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/367,503

(22) Filed: Mar. 28, 2019

(65) Prior Publication Data

US 2019/0305460 A1 Oct. 3, 2019

(30) Foreign Application Priority Data

Mar. 30, 2018 (JP) ..... 2018-066898

(51) Int. Cl.
*H01R 13/405* (2006.01)
*H01R 13/516* (2006.01)
(Continued)

(52) U.S. Cl.
CPC ..... *H01R 13/405* (2013.01); *H01R 13/516* (2013.01); *H01R 13/521* (2013.01); *H01R 13/5202* (2013.01); *H01R 13/748* (2013.01)

(58) Field of Classification Search
CPC ..... H01R 13/5205; H01R 13/405; H01R 13/516; H01R 13/521; H01R 13/748
(Continued)

(56) References Cited

U.S. PATENT DOCUMENTS 6,953,357 B2 * 10/2005 Fukushima ..... H01R 13/5219 439/271
7,828,591 B2 * 11/2010 Matsuoka ..... H01R 4/183 439/559
(Continued)

FOREIGN PATENT DOCUMENTS

JP 62-038463 A 3/1987
JP 2009-295492 A 12/2009
(Continued)

OTHER PUBLICATIONS

Communication dated Jul. 25, 2019, issued by the European Patent Office in counterpart European Patent Application No. 19165426.8.

*Primary Examiner* — Peter G Leigh
(74) *Attorney, Agent, or Firm* — Sughrue Mion, PLLC

(57) ABSTRACT

A vehicular device has a device main body, a device box housing the device main body, a terminal block attached to a wall of the device box, and a wire harness electrically connected to the device main body via the terminal block. The terminal block includes an O-ring. The O-ring has a ring-shaped O-ring main body and a lock target portion which is continuous with the O-ring main body. The lock target portion has a connection portion which is continuous with the O-ring main body at one end and a lock target portion main body which is continuous with the other end of the connection portion and projects perpendicularly to an extension direction of the connection portion. The lock target portion main body has a hollow portion in a base portion which is continuous with the other end of the connection portion, and thereby assumes a tubular shape.

9 Claims, 13 Drawing Sheets

(51) Int. Cl.
*H01R 13/52* (2006.01)
*H01R 13/74* (2006.01)

(58) Field of Classification Search
USPC ..... 439/606
See application file for complete search history.

(56) References Cited

U.S. PATENT DOCUMENTS

| | | | | |
|---|---|---|---|---|
| 8,556,660 | B2 * | 10/2013 | Matsuoka | B29C 45/1671 439/606 |
| 9,059,534 | B2 * | 6/2015 | Endo | H01R 13/52 |
| 9,954,304 | B2 * | 4/2018 | Wang | H01R 13/5202 |
| 2002/0031949 | A1 * | 3/2002 | Miyazaki | H01R 13/5202 439/625 |
| 2007/0184701 | A1 * | 8/2007 | Yagome | H01R 13/506 439/271 |
| 2011/0195603 | A1 * | 8/2011 | Fujiwara | H01R 13/6596 439/607.28 |
| 2011/0230086 | A1 * | 9/2011 | Fujiwara | H01R 13/5202 439/559 |
| 2013/0217262 | A1 | 8/2013 | Ikeda et al. | |

FOREIGN PATENT DOCUMENTS

| | | | | |
|---|---|---|---|---|
| JP | 2009295492 | A | * | 12/2009 |
| JP | 2012-69261 | A | | 4/2012 |
| JP | 2013-002464 | A | | 1/2013 |
| JP | 2013-80668 | A | | 5/2013 |
| JP | 2013080668 | A | * | 5/2013 |

* cited by examiner

TENTATIVE SETTING STATE (O-RING)

BEFORE LOCKING

LOCKED STATE

AFTER LOCKING

O-RING, O-RING LOCK STRUCTURE, TERMINAL BLOCK, AND VEHICULAR DEVICE

CROSS-REFERENCE TO RELATED APPLICATIONS

This application is based on and claims priority under 35 USC 119 from Japanese Patent Application No. 2018-066898 filed on Mar. 30, 2018, the contents of which are incorporated herein by reference.

TECHNICAL FIELD

The present invention relates to an O-ring having an O-ring main body and lock target portions which are continuous with the O-ring main body and on which an attachment counterpart is to be locked. The invention also relates to an O-ring lock structure as well as a terminal block and a vehicular device that include an O-ring as a constituent element.

BACKGROUND ART

Among known terminal blocks that are attached to a wall of a device box and used for electrical connection between the inside and the outside of the wall is one disclosed in the following Patent document 1. The configuration of this terminal block will be described below briefly with reference to FIGS. 12 and 13. The terminal block 1 is composed of a housing 2, a busbar 3 and a stud bolt 4, O-rings 5 and 6, and a holder 7.

The housing 2, which is attached to a wall of a device box (not shown) by bolts (not shown), has a wall insertion portion 8 to be inserted into an insertion hole that penetrates through the wall and a housing main body 9 which is continuous with the wall insertion portion 8. The busbar 3 has a busbar main body 10, an outside terminal portion 11 which is continuous with the busbar main body 10 at its one end, and an inside terminal portion 12 which is continuous with the busbar main body 10 at its other end. The outside terminal portion 11 is bent from the busbar main body 10 by 90°, whereby the busbar 3 is approximately L-shaped. The terminal block 1 is assembled in such a manner that the busbar main body 10 of the busbar 3 is inserted into the housing 2 and the holder 7.

The busbar 3 is disposed so that the inside terminal portion 12 is exposed inside the wall and the outside terminal portion 11 is exposed outside the wall. In a state that the terminal block 1 is assembled, the stud bolt 4 is inserted in the outside terminal portion 11.

The O-ring 5 serves to ensure necessary waterproofness between the housing 2 and the busbar 3. The O-ring 6 serves to ensure necessary waterproofness between the wall (through-hole) and the housing 2. The holder 7 serves to prevent dropping of the O-ring 5 attached to the housing main body 9. The holder 7 has two lock portions 13, and the housing main body 9 also has two lock portions 14. In the terminal block 1, the holder 7 is fixed to the housing main body 9 when the lock portions 13 are locked on the respective lock portions 14, whereby the O-ring 5 is prevented from coming off.

As seen from FIGS. 12 and 13, the locking between the lock portions 13 and the lock portions 14 is made in the vicinities of portions (bolt fixing holes 15) where the housing 2 is fixed to the wall.

As shown in FIGS. 12 and 13, the busbar 3 is locked on a housing-side lock portion (not shown) which is formed inside the wall insertion portion 8. A busbar-side lock hole 16 is formed in the busbar main body 10. The outside terminal portion 11 of the busbar 3 is formed with a pair of engagement pieces 17.

Referring to FIG. 12, the O-ring 6 is attached to a bottom surface (i.e., a surface opposed to the above-mentioned wall of the device box) of the housing main body 9. The O-ring 6 has an O-ring main body 18 and projections 19 which project from the O-ring main body 18. The projections 19 serve as press-fitting portions for preventing the O-ring 6 from coming off.

PRIOR ART DOCUMENTS

Patent Documents

Patent document 1: JP-A-2012-69261

SUMMARY OF INVENTION

The above-described conventional technique has a problem that the O-ring 6 may come off the bottom surface of the housing main body 9 before attachment of the terminal block 1 to the wall of the device box, for example, during transport of the terminal block 1. The inventors of the present invention thought of whether it is possible to replace the O-ring 6 with an O-ring that is formed with, instead of the projections 19 that are press-fitting portions, lock target portions that can be locked on the bottom surface reliably and are simple in structure.

The present invention has been made in view of the above circumstances, and an object of the invention is therefore to provide an O-ring capable of preventing itself from coming off though being simple in structure. Another object of the invention is to provide a lock structure of the O-ring and a terminal block and a vehicular device that include the O-ring as a constituent element.

To attain one of the above objects, one aspect of the invention provides an O-ring having a ring-shaped O-ring main body and a lock target portion which is continuous with the O-ring main body and is locked on an attachment counterpart. The lock target portion has a connection portion which is continuous with the O-ring main body at one end and a lock target portion main body which is continuous with the other end of the connection portion and projects perpendicularly to an extension direction of the connection portion. The lock target portion main body has a hollow portion in a base portion which is continuous with the other end of the connection portion, and is formed in a tubular shape.

According to the present invention having the above the O-ring, each lock target portion of the O-ring has the connection portion and the lock target portion main body which has a tubular shape. As a result, the lock target portion is naturally made simple in structure. Furthermore, a constricted portion which is effective in locking can be formed easily by shrinking the tubular portion of the lock target portion main body. As such, the O-ring provides an advantage that it is prevented from coming off though being simple in structure. In this aspect of the invention, in other words, the lock target portion main body merely having a portion that can be constricted easily can provide the same effect as, for example, pawl-shaped lock projections.

Further, the base portion of the lock target portion main body is shaped like a cylindrical tube and a tip portion of the lock target portion main body has a ring-shaped taper.

According to the O-ring having the above feature, since each lock target portion has the portion shaped like a cylindrical tube and the ring-shaped taper, it has such a simple structure as to facilitate die cutting and to be easily inserted into the O-ring lock portion. Furthermore, having the portion that is shaped like a cylindrical tube, each lock target portion can form a constricted portion having a uniform thickness distribution in the circumferential direction and hence contributes to maintaining a stable locking state.

Moreover, in the present invention, the connection portion is located at such a position with respect to the O-ring main body as to satisfy a relationship H S, where H is a pre-crushing height of the O-ring main body from an attachment contact surface, located on the side of contact to the attachment counterpart, of the O-ring main body to an outside surface of the connection portion and S is a post-crushing interval between the attachment counterpart and a wall surface opposed to the attachment counterpart.

According to the O-ring having the above feature, the lock target portion main body can be located so that the attachment counterpart is locked surely on the lock target portion main body. The details of the arrangement of the lock target portion main body and the other portions involved will be described in the embodiments.

In addition, the O-ring has such a shape that a parting line of a die for molding the O-ring extends along the extension direction of the connection portion beside the connection portion.

According to the O-ring having the above feature, since the lock target portion has a simple structure, the parting line can be set at the above-mentioned position. As a result, the die parting structure of a die for molding the O-ring can be made simple.

To attain another of the above objects, another aspect of the invention provides an O-ring lock structure including the O-ring according to the above features; and an attachment counterpart to which O-ring is attached. The attachment counterpart has an O-ring housing portion which houses the O-ring main body of the O-ring and O-ring lock portions which are locked on the respective lock target portions of the O-ring. In addition, the O-ring lock portion is formed so as to constrict the lock target portion main body of the lock target portion.

According to the O-ring lock structure having the above feature, the portion having the tubular shape of the lock target portion main body can be constricted. The O-ring can be prevented from coming off by locking the O-ring lock portion on the constricted portion.

To attain another of the above objects, yet another aspect of the invention provides a terminal block including the O-ring according to the above features; a housing as an attachment counterpart of the O-ring; and a busbar which is housed in the housing and serves for electrical connection. Further, the O-ring is locked on the housing so as to be located between the housing and a wall of an attachment destination of the housing.

According to the terminal block having the above feature, a highly reliable terminal block can be provided in which the O-ring is prevented from coming off.

In the above terminal block, the O-ring is shaped so that the connection portions of the respective lock target portions of the O-ring come into contact with the wall of the attachment destination or an O-ring attachment jig.

According to the terminal block having the above feature, in the case where the lock target portion is not in a lock state, it can be rendered in a lock state by pushing it by bringing the wall of the attachment destination or the O-ring attachment jig into contact with the connection portion.

To attain the other of the above objects, a further aspect of the invention provides a vehicular device including a device main body; a device box which houses the device main body; the terminal block according to the above feature which is attached to a wall of the device box; and a wire harness which is electrically connected to the device main body via the terminal block.

According to the present invention having the above feature, the terminal block which is highly reliable because the O-ring is prevented from coming off is included. Thereby, the vehicular device of the present invention makes it possible to provide a better vehicular device.

Advantages of the Invention

The O-ring and the O-ring lock structure according to the invention provide an advantage that they can prevent the O-ring from coming off though being simple in structure. The invention provides a better terminal block and vehicular device because they include the O-ring as a constituent element.

BRIEF DESCRIPTION OF DRAWINGS

FIG. 9A shows a state before locking, and FIG. 9B shows a locked state.

FIG. 10A shows a tentative setting state, and FIG. 10B shows the state before locking.

FIG. 11A shows the locked state, and FIG. 11B shows a state after locking.

DESCRIPTION OF EMBODIMENTS

A vehicular device, which is installed in a vehicle, is equipped with a device main body, a device box which houses the device main body, a terminal block attached to a wall of the device box, and a wire harness electrically connected to the device main body via the terminal block. The terminal block includes, as a constituent element, an O-ring which can prevent itself from coming off though being simple in structure. The O-ring has a ring-shaped O-ring main body and lock target portions which are continuous with the O-ring main body. Each lock target portion has a connection portion which is continuous with the O-ring main body at one end and a lock target portion main body which is continuous with the other end of the connection portion and projects perpendicularly to an extension direction of the connection portion. The lock target portion main body has a hollow portion in a base portion which is continuous with the other end of the connection portion, and thereby assumes a tubular shape.

Embodiment 1

Figure 1:
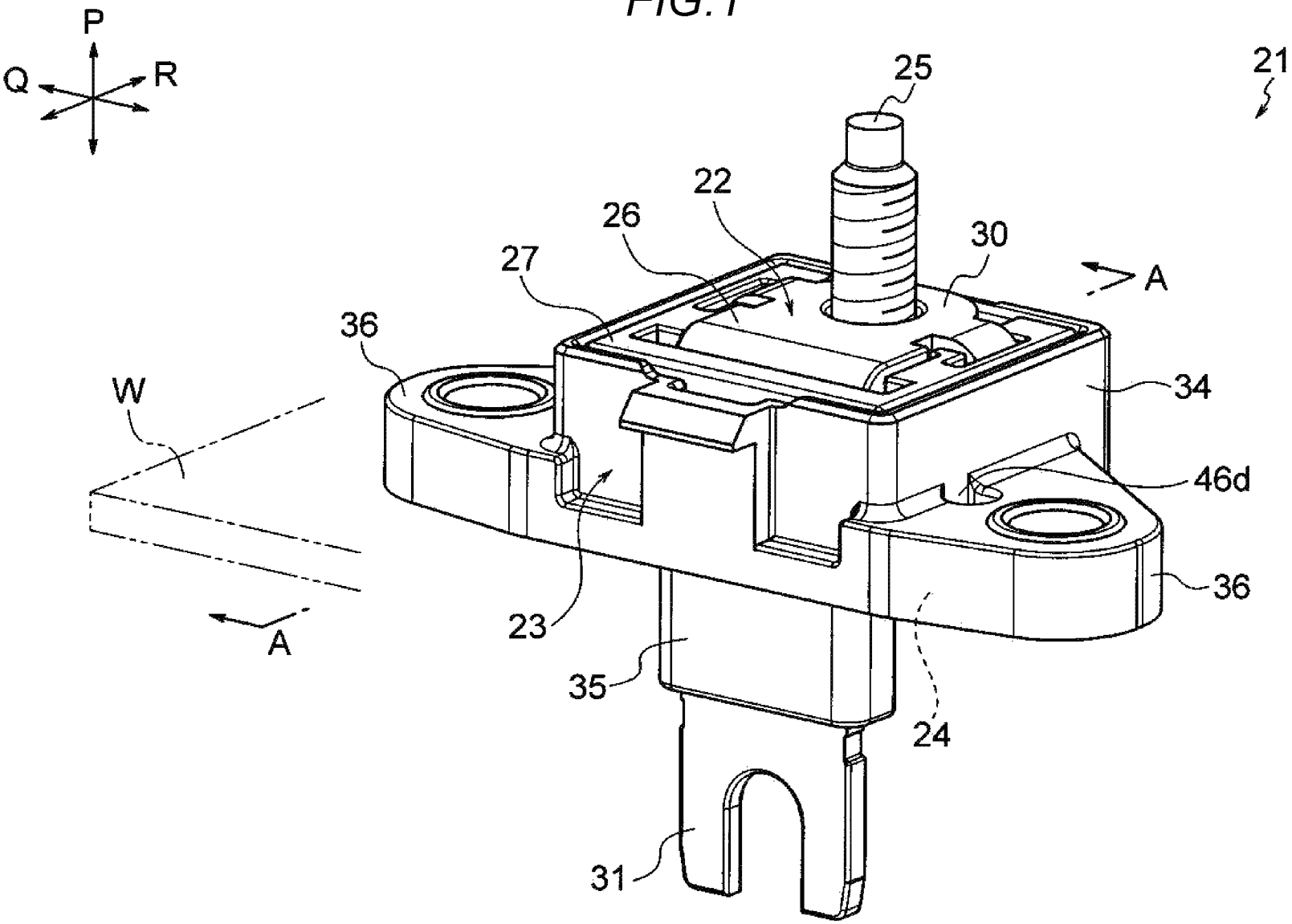
FIG. 1 is a perspective view of a terminal block according to a first embodiment that includes an O-ring according to the first embodiment as a constituent element.
Figure 2:
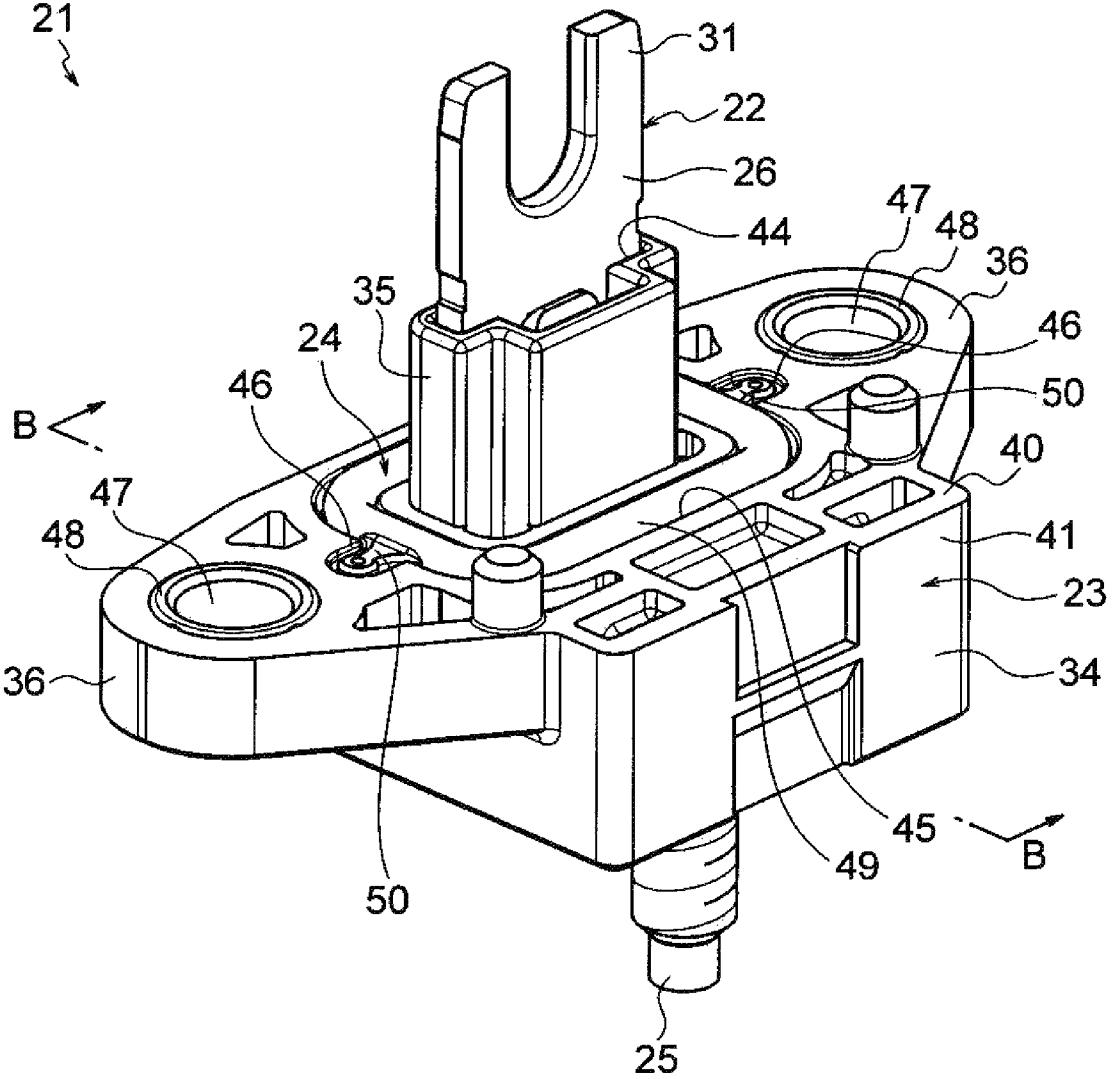
FIG. 2 is a perspective view of the terminal block as viewed from the side of attachment of the O-ring.
Figure 3:
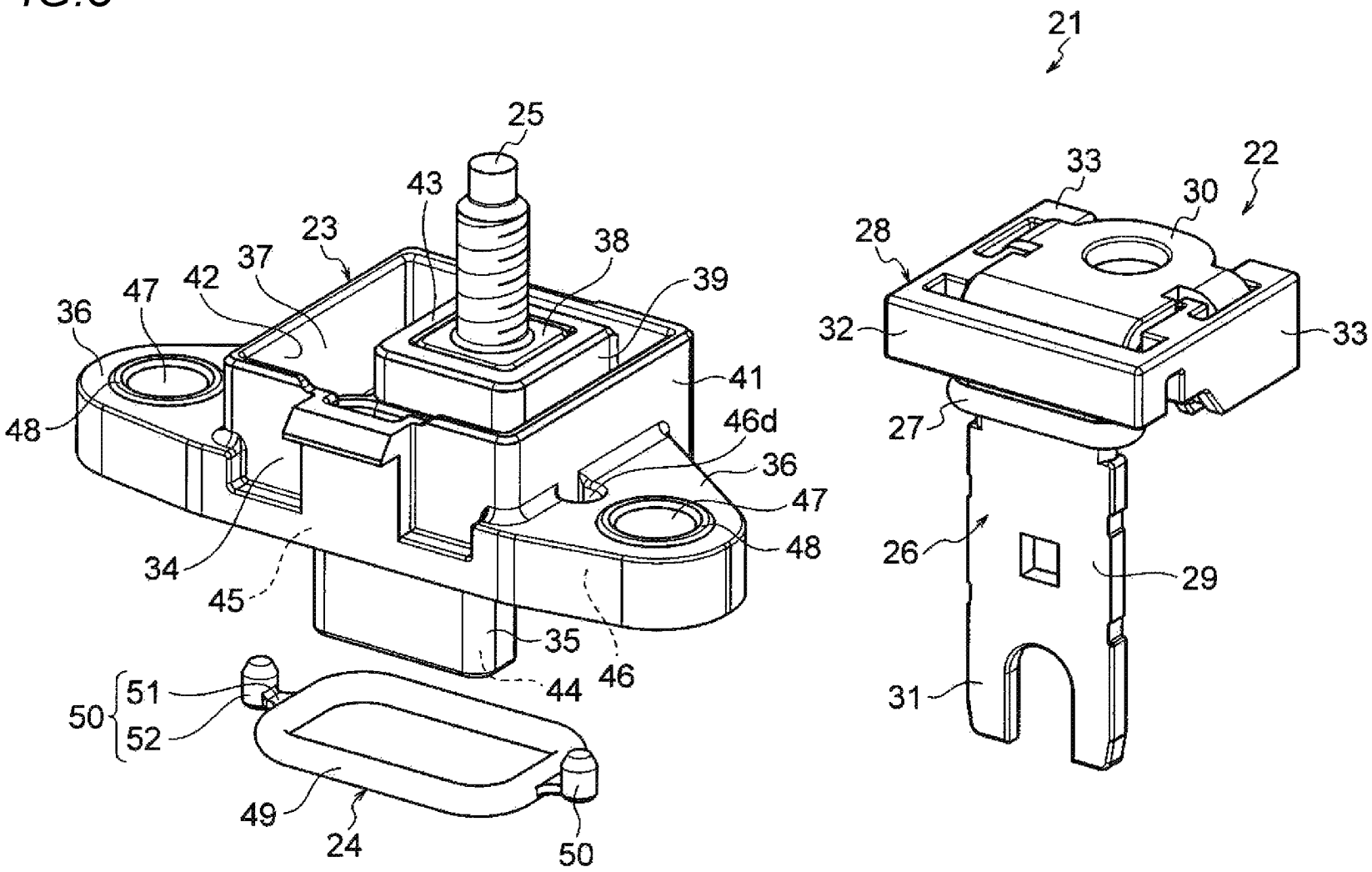
FIG. 3 is an exploded perspective view of the terminal block.
Figure 4:
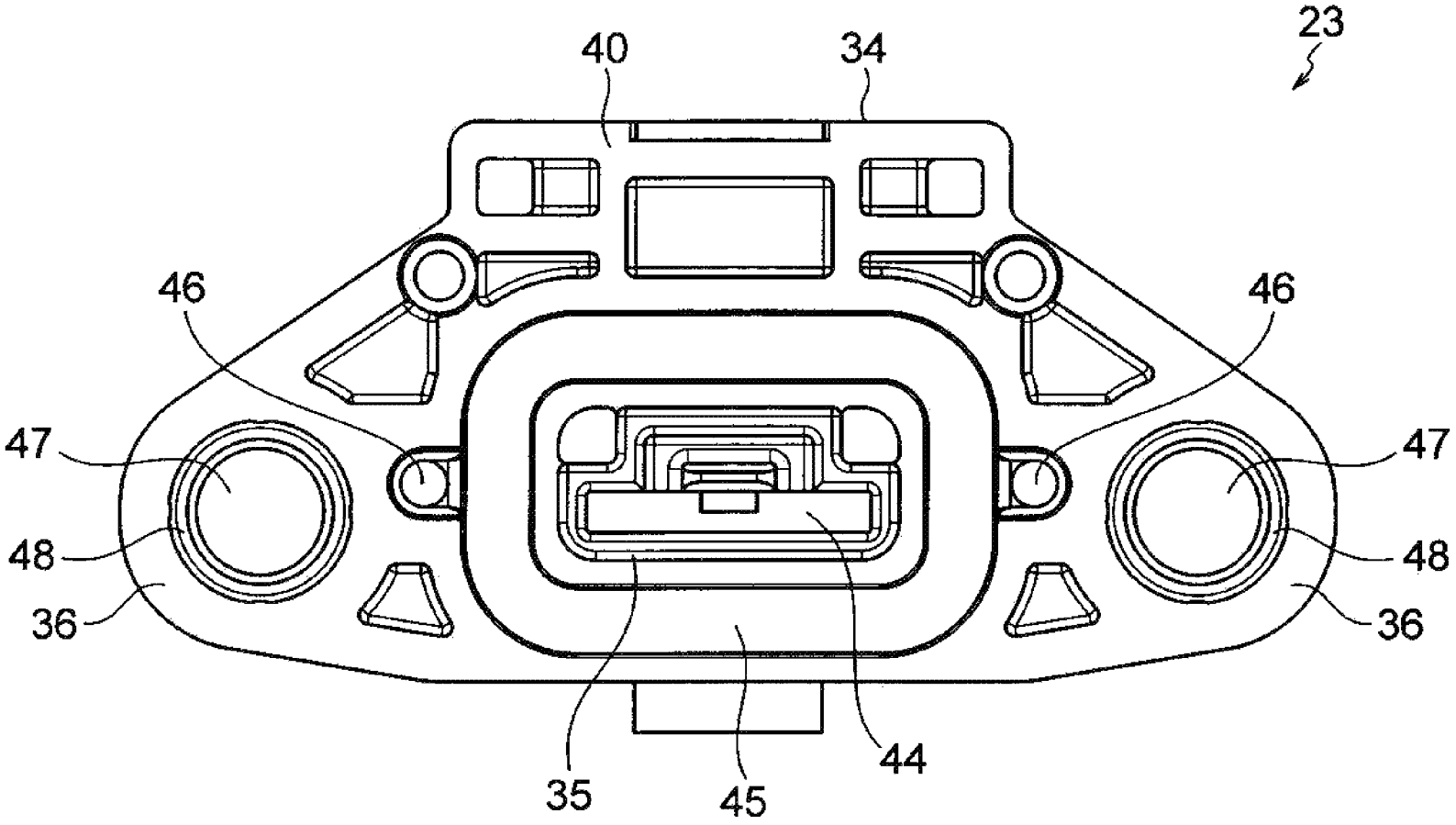
FIG. 4 is a bottom view of a housing 23.
Figure 5A:
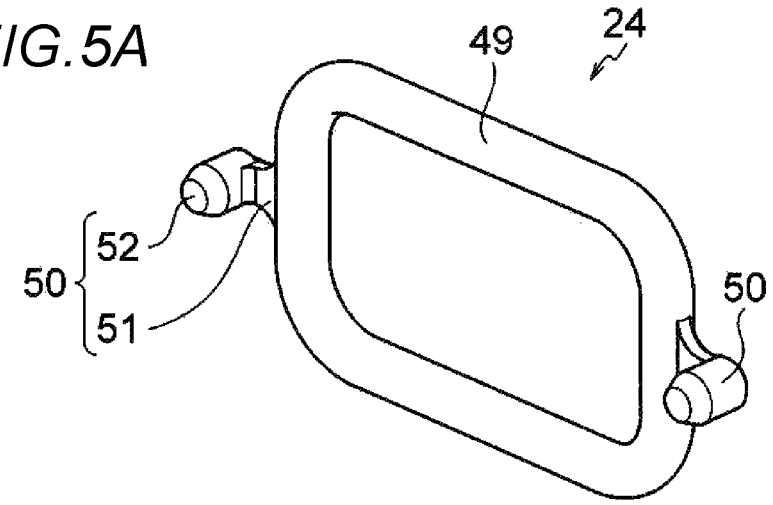
FIG. 5A is a perspective view of the O-ring.
Figure 5B:
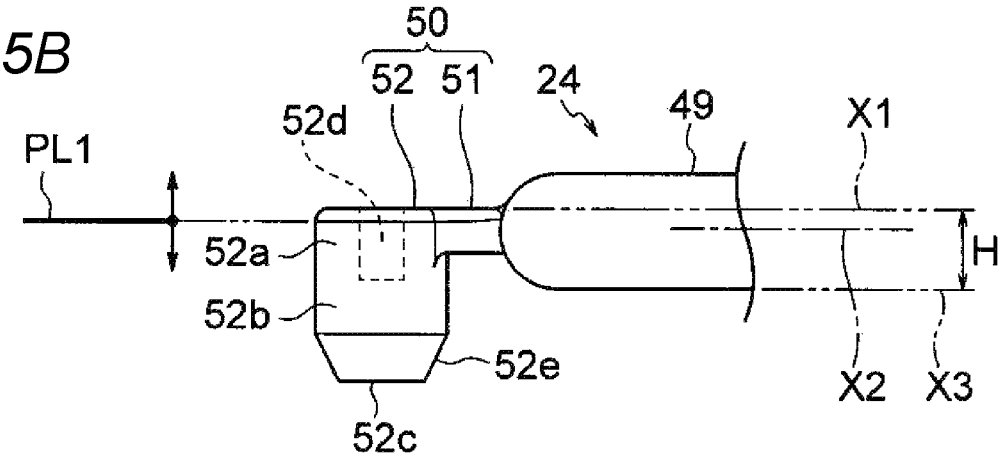
FIG. 5B is a view showing the structure of a lock target portion.
Figure 5C:
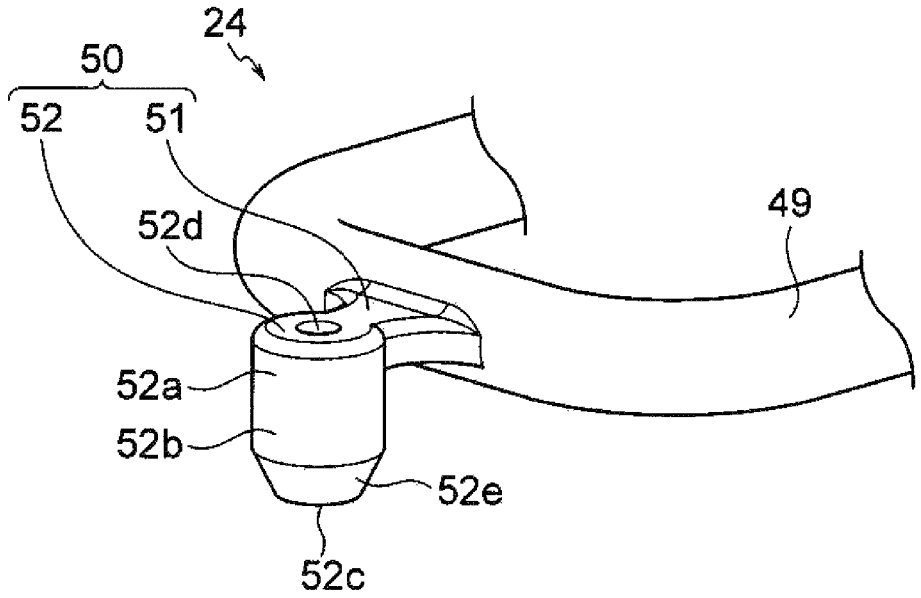
FIG. 5C is a perspective view of the lock target portion.
Figure 6:
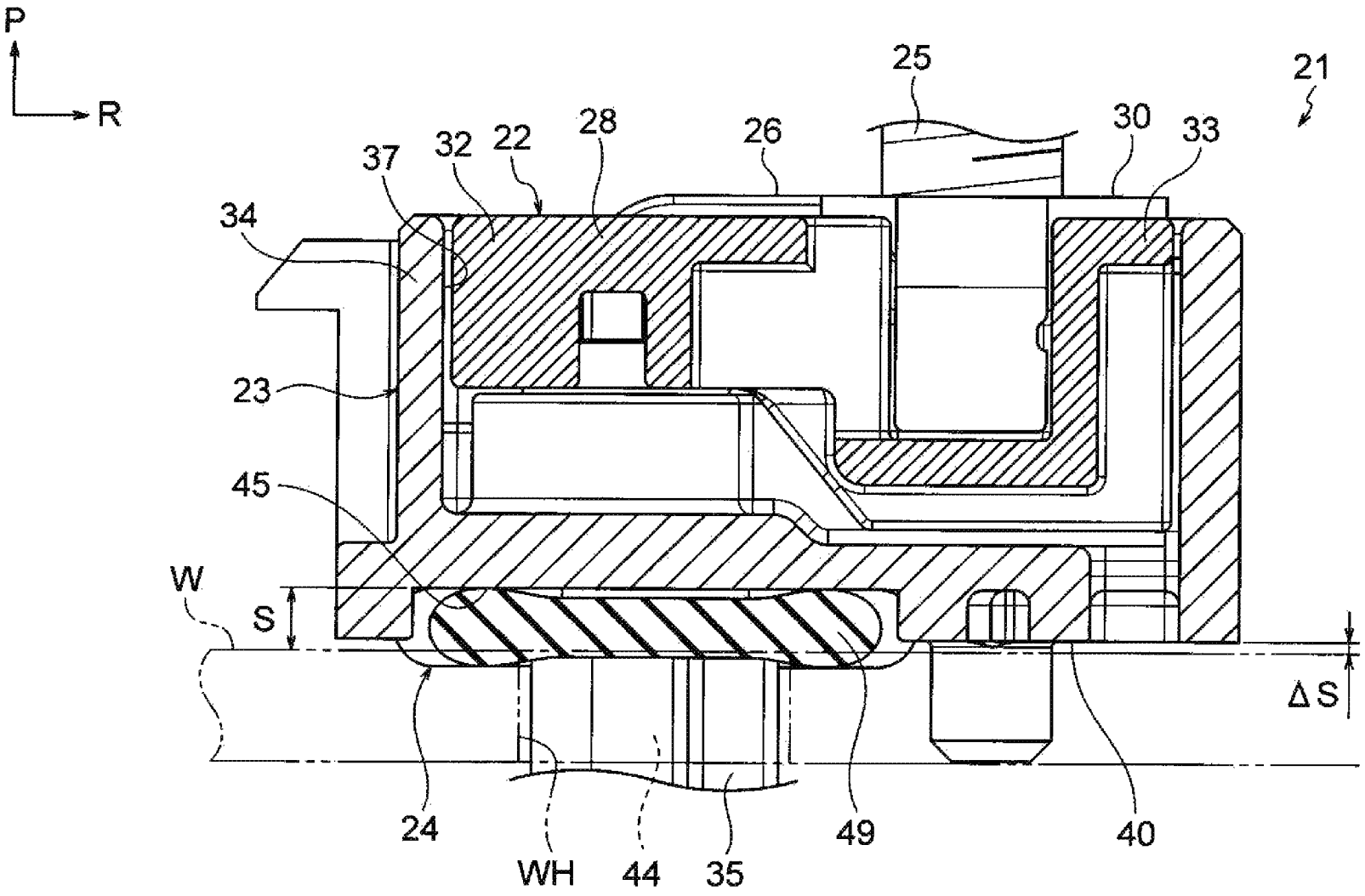
FIG. 6 is a sectional view taken along line A-A in FIG. 1.
Figure 7A:
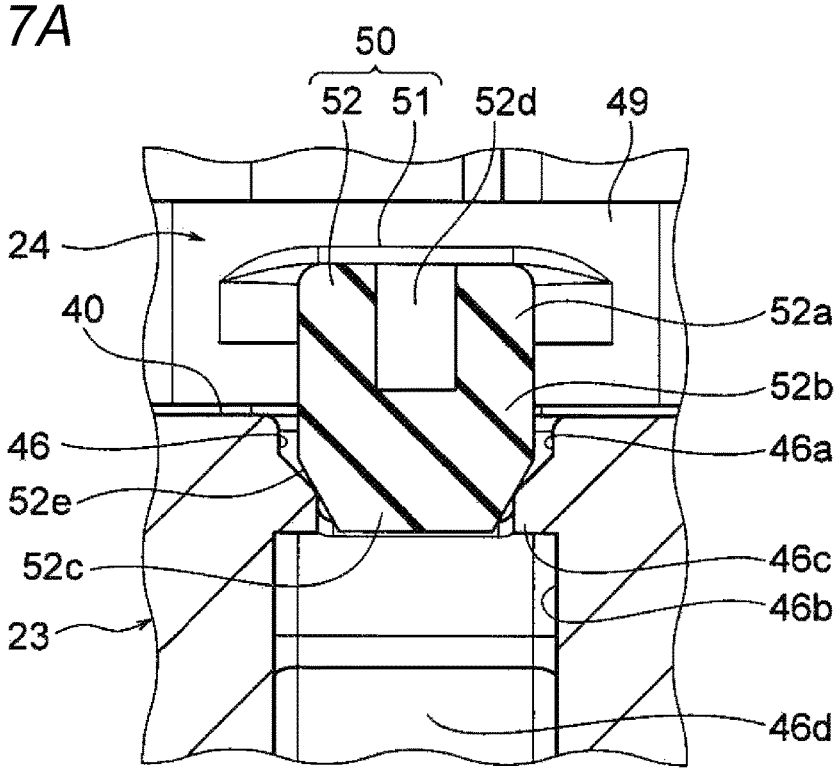
FIGS. 7A and 7B are sectional views taken along line B-B in FIG. 2 and illustrate a process of locking of the O-ring, and show states before and after locking, respectively.
Figure 7B:
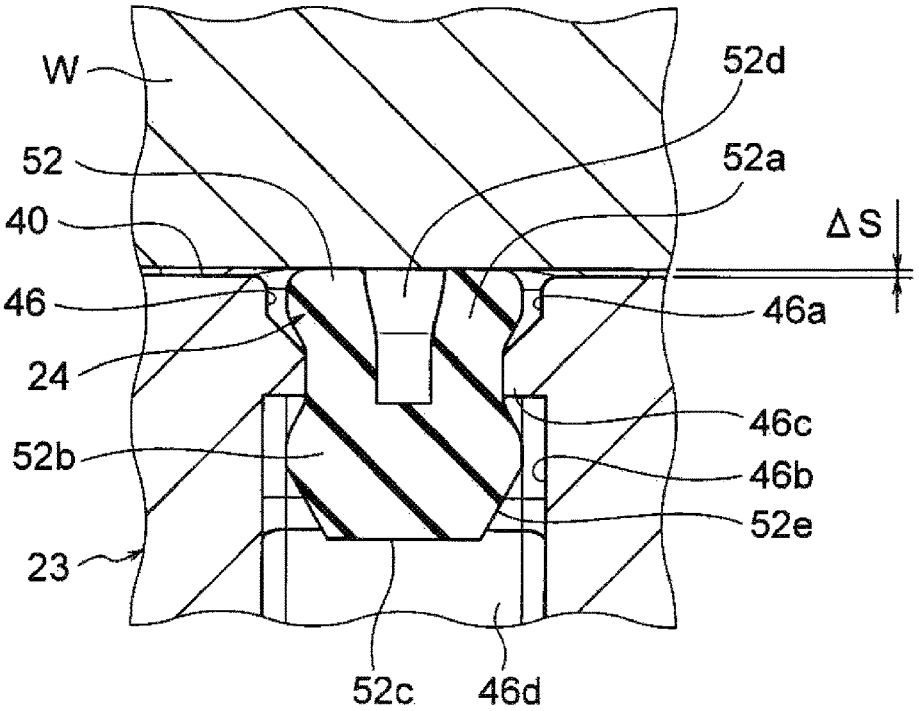

A first embodiment of the present invention will be hereinafter described with reference to the drawings. FIG. 1 is a perspective view of a terminal block 21 according to the first embodiment that includes an O-ring 24 according to the first embodiment as a constituent element. FIG. 2 is a perspective view of the terminal block 21 as viewed from the side of attachment of the O-ring 24. FIG. 3 is an exploded perspective view of the terminal block 21. FIG. 4 is a bottom view of a housing 23. FIGS. 5A-5C are views of the O-ring 24. FIG. 6 is a sectional view taken along line A-A in FIG. 1. FIGS. 7A and 7B illustrate a process of locking of the O-ring 24.

In the embodiment, arrows P, Q, and R shown in FIG. 1 represent the top-bottom direction, the left-right direction, and the front-rear direction, respectively.

<Configuration of Terminal Block 21>

The terminal block 21 shown in FIG. 1 is attached to a wall W of a metal device box of, for example, a DC-DC converter (vehicular device) that is installed in an automobile. In the embodiment, three terminal blocks 21 for input and output are attached to the device box of at prescribed positions, respectively. The three terminal blocks 21 have the same configuration and one of them will be described below.

As shown in FIGS. 1-3, the terminal block 21, which used for electrical connection between the inside and the outside of the wall W, is composed of a busbar component 22, a resin housing 23 to which the busbar component 22 is attached, and an O-ring 24 and a stud bolt 25 which are attached to the housing 23. The terminal block 21 is connected to a device main body (not shown) inside the wall W, and a wire harness (not shown) is connected to the terminal block 21 outside the wall W. The wire harness is connected to the device main body via the terminal block 21. Although in the embodiment a terminal metal fitting of the wire harness is connected to the terminal block 21 from above, this connection direction is just an example.

As will be seen from the following description, the terminal block 21 is characterized in that the O-ring 24 is simple in structure and prevents itself from coming off.

<Busbar Component 22>

As shown in FIGS. 1-3, the busbar component 22 is equipped with a busbar 26, an O-ring 27, and a holder 28. The busbar 26 is formed by press-forming a conductive, relatively thick metal plate. The busbar 26 is formed into the shape shown in FIG. 3 so as to have a busbar main body 29, an outside terminal portion 30, and an inside terminal portion 31.

Made of rubber or elastomer and hence being elastic, the O-ring 27 is provided to ensure necessary waterproofness between the busbar 26 and the housing 23. The O-ring 27 is approximately shaped like an approximately elliptical ring in a plan view.

The holder 28, which is a resin member for holding the O-ring 27 by pressing it, has a holder main body 32 and a pair of terminal engagement portions 33 and is shaped as shown in FIG. 3. The holder 28 is shaped so as to be attached to the busbar 26 to become a constituent member of the busbar component 22 and then housed in a holder housing portion 51 (described later) of the housing 23. The holder 28 is attached to the busbar 26 to become a constituent element of the busbar component 22 and then housed in a holder housing portion 37 (described later) of the housing 23.

<Housing 23>

As shown in FIGS. 1-4, the housing 23, which is a member constituting the terminal block 21 together with the above-described busbar component 22, is composed of a housing main body 34, a wall insertion portion 35, and a pair of main body fixing portions 36 and shaped as shown in these figures. When the housing 23 itself is attached to the wall W, the housing main body 34 is located outside the wall W and the wall insertion portion 35 penetrates through the wall W and its tip portion is located inside the wall W. The housing 23 is fixed the wall W by bolts (not shown). The housing 23 is an example of the term "attachment counterpart" (of the O-ring 24) used in the claims.

<Housing Main Body 34>

As shown in FIGS. 1-4, the housing main body 34 has a holder housing portion 37 for housing the holder 28 of the busbar component 22 and a bolt housing portion 39 for housing and holding a head 38 of the stud bolt 25. The holder housing portion 37 is formed by a bottom wall 40 of the housing main body 34 and a circumferential wall 41 which is shaped like a rectangular frame. The inner surfaces of the circumferential wall 41 are formed with holder guide portions 42 for guiding the holder 28 of the busbar component 22.

The bolt housing portion 39 is formed inside the holder housing portion 37 and has a terminal support portion 43 which serves as a portion for receiving the outside terminal portion 30 of the busbar component 22.

<Wall Insertion Portion 35>

As shown in FIGS. 1-4, the wall insertion portion 35 is integrated with the housing main body 34 and extends straightly from the bottom surface of the housing main body 34 (i.e., from the outer surface of the bottom wall 40 of the housing main body 34). The wall insertion portion 35 is a portion to be inserted into an insertion hole WH (see FIG. 6) of the wall W. The wall insertion portion 35 has a busbar insertion hole 44.

<O-Ring Housing Portion 45>

As shown in FIG. 2 and FIGS. 7A and 7B, the outer surface of the bottom wall 40 of the housing main body 34 is formed with an O-ring housing portion 45 outside the wall insertion portion 35, that is, so as to surround the wall insertion portion 35. The O-ring housing portion 45 is a portion for housing an O-ring main body 49 (described later) of the O-ring 24 which serves for sealing between the bottom wall 40 and the wall W. As shown in FIG. 4, the O-ring housing portion 45 is a ring-shaped, shallow groove.

The O-ring housing portion 45 is formed with, at outside positions, a pair of O-ring lock portions 46 which are to be locked on a pair of lock target portions 50 (described later) which are continuous with the O-ring main body 49, respectively.

<Pair of O-Ring Lock Portions 46>

As shown in FIGS. 7A and 7B, each of the pair of O-ring lock portions 46 is a hole and has an opening-side lock portion 46*a*, a deep-side lock portion 46*b*, and a lock step portion 46*c*. The opening-side lock portion 46*a* is an opening-side portion of the hole. The deep-side lock portion 46*b* is a deep-side portion of the hole. The lock step portion 46*c* is a portion connecting the opening-side lock portion 46*a* and the deep-side lock portion 46*b*. The lock step portion 46*c* is narrower (smaller in diameter) than each lock target portion 50 of the O-ring 24. The lock step portion 46*c* is a step portion that is approximately shaped like a pawl in cross section so as to be able to be locked on the associated lock target portion 50. More specifically, the O-ring lock portions 46 is an approximately pawl-shaped step portion that can be locked on the associated lock target portion 50 by reducing its diameter (i.e., by constricting it).

For each O-ring lock portion 46, a die cutting hole 46*d* (see FIG. 3) is formed for formation of the lock step portion 46*c*. The die cutting hole 46*d* is formed outside the O-ring lock portion 46 at a base position of the associated one of the pair of main body fixing portions 36.

<Pair of Main Body Fixing Portions 36>

As shown in FIGS. 1-4, the pair of main body fixing portions 36, which are fixing portions for attaching the housing 23 to the wall W, are continuous with respective side portions of the housing main body 34. Bolt fixing holes 47 for fixing by bolts (not shown) are formed through the pair of main body fixing portions 36, respectively. Cylindrical metal collars 48 are attached to the respective bolt fixing holes 47.

<O-Ring 24>

As shown in FIGS. 2, 3, and 5A-5C, the O-ring 24, which is elastic, serves to ensure necessary waterproofness for around the insertion hole WH (see FIG. 6) which penetrates through the wall W (in other words, necessary waterproofness between the wall W and the housing 23). The O-ring 24 has the O-ring main body 49 and the pair of lock target portions 50 for preventing the O-ring 24 itself from coming off, and is shaped as shown in these figures.

<O-Ring Main Body 49>

As shown in FIGS. 2, 3, 5A-5C, and 6, the O-ring main body 49 assumes an approximately rectangular ring shape in a plan view and is circular in cross section. The O-ring main body 49 is to be housed in the O-ring housing portion 45 of the housing 23.

<Pair of Lock Target Portions 50>

As shown in FIG. 3 and FIGS. 5A-5C, the pair of lock target portions 50 are continuous with the O-ring main body 49 from outside. The pair of O-ring lock portions 46 (see FIG. 4) of the housing 23 are to be locked on the pair of lock target portions 50, respectively.

The pair of lock target portions 50 have the same shape and hence one of them will be described below. Each lock target portion 50 has a connection portion 51 and a lock target portion main body 52 and is shaped as shown in FIGS. 5A-5C.

<Connection Portion 51>

As shown in FIGS. 5A-5C and FIGS. 7A and 7B, the connection portion 51 is continuous with the O-ring main body 49 at one end and with the lock target portion main body 52 at the other end. That is, the connection portion 51 is a short arm-shaped portion which connects the O-ring main body 49 and the lock target portion main body 52. The connection portion 51 is formed in such a manner that the position of an imaginary line X1 is located above the center line X2 of the O-ring main body 49 (as viewed in FIG. 5B) and has a height H from the position of an imaginary line X3 which is the bottom position (the position of contact at the time of attachment) of the O-ring main body 49. The height H will be described later.

<Lock Target Portion Main Body 52>

As shown in FIGS. 5A-5C and FIGS. 7A and 7B, the lock target portion main body 52 is a portion on which the associated O-ring lock portion 46 of the housing 23 is to be locked. The lock target portion main body 52 has a base portion 52*a* which is continuous with the other end of the connection portion 51, an intermediate portion 52*b* which is continuous with the base portion 52*a*, and a tip portion 52*c* which is continuous with the intermediate portion 52*b*, and is formed so as to extend perpendicularly to the extension direction of the connection portion 51 (i.e., the extension direction of the imaginary line X1). In other words, the lock target portion main body 52 is formed so as to extend straightly downward in FIG. 5B.

The base portion 52*a* of the lock target portion main body 52 is shaped like a cylindrical tube (this is just an example; it suffices that the base portion 52*a* be tubular). The cylindrical tube shape is obtained by forming a hollow portion 52*d* inside the base portion 52*a*. The hollow portion 52*d* is a hole that is open at one end and closed at the other end (bottom) that is in the vicinity of the intermediate portion 52*b*. The hollow portion 52*d* is formed so that the base portion 52*a* is made easier to shrink and that, conversely, the tip portion 52*c* is made hard to shrink. As shown in FIG. 7B, the hollow portion 52*d* is formed so that the base portion 52*a* can be constricted.

It goes without saying that when the base portion 52*a* is constricted by the associated O-ring lock portion 46, a locking state is established there as shown in FIG. 7B.

The tip portion 52*c* is formed with a ring-shaped taper 52*e* and thereby tapered. The taper 52*e* is formed to allow the tip portion 52*c* to be guided by the associated O-ring lock portion 46. As seen from a parting line PL1 shown in FIG. 5B schematically, the die parting structure is simpler in the case of the lock target portion main body 52 than in the case of a lock target portion main body 66 shown in FIG. 8B (parting line PL2).

<Locking State of Lock Target Portion 50>

As shown in FIGS. 5A-5C and FIGS. 7A and 7B and as described above, the lock target portion 50 has the connection portion 51 and the lock target portion main body 52. In the lock target portion main body 52, whereas the base portion 52*a* is easy to shrink because it is tubular, the intermediate portion 52*b* and the tip portion 52*c* are more difficult to shrink than the base portion 52*a*. Thus, when the lock target portion main body 52 is pushed into the associated O-ring lock portion 46 in attaching the O-ring 24 to the housing 23, the base portion 52*a* of the lock target portion main body 52 is shrunk by the lock step portion 46*c* of the O-ring lock portion 46 and constricted there. Since the base portion 52*a* is constricted, a locking state is established by the lock step portion 46*c* and the intermediate portion 52*b* of the lock target portion main body 52. It goes without saying that the O-ring 24 does not come off once a locking state is established even if, for example, the O-ring 24 receives a force in its coming-off direction during transport.

<Advantages of O-Ring 24>

As described above with reference to FIG. 1 to FIGS. 7A and 7B, in the O-ring 24 according to the first embodiment of the invention, each lock target portion 50 has the connection portion 51 and the lock target portion main body 52 which has a tubular shape. As a result, the lock target portion 50 is naturally made simple in structure. Furthermore, a constricted portion which is effective in locking can be formed by shrinking the tubular portion (base portion 52*a*) of the lock target portion main body 52. As such, the O-ring 24 provides an advantage that it is prevented from coming off though being simple in structure.

<Advantages of Terminal Block 21 (and Vehicular Device)>

A better terminal block (and vehicular device) can be provided because as described above the terminal block 21 (and vehicular device) is highly reliable by virtue of the use of the O-ring 24 which does not come off.

Embodiment 2

Figure 8A:
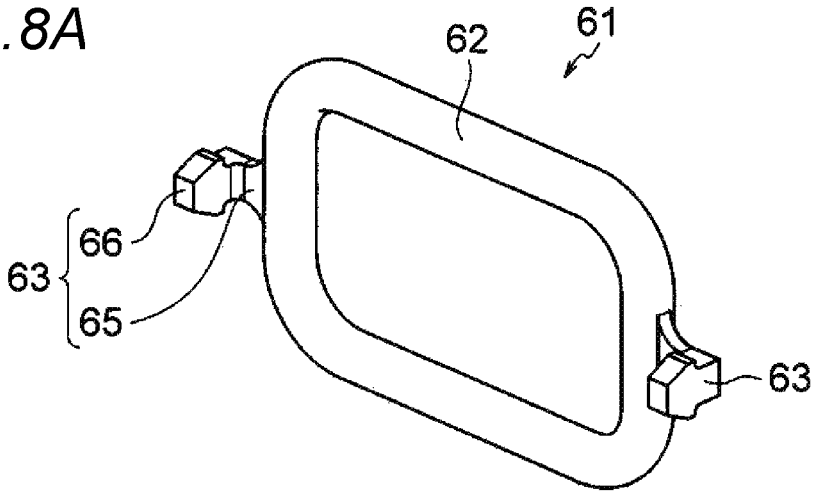
FIG. 8A is a perspective view of the O-ring.
Figure 8B:
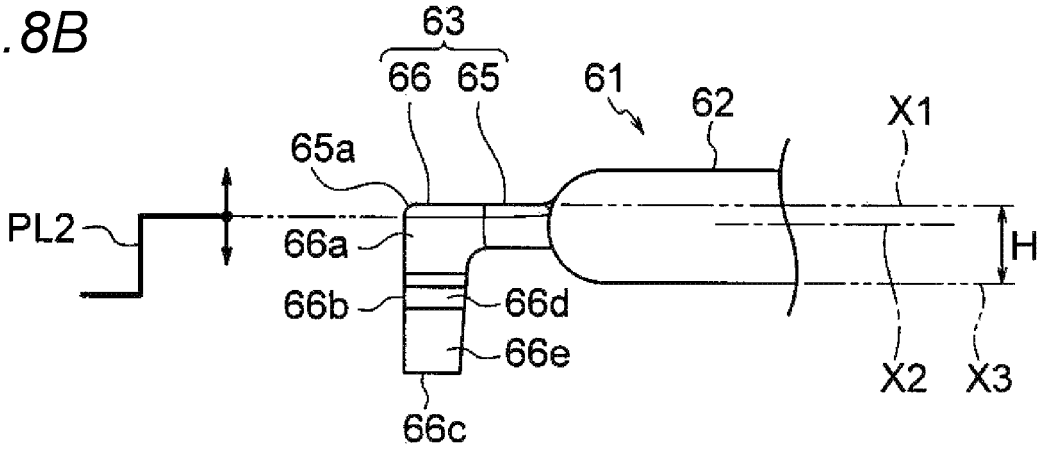
FIG. 8B is a view showing the structure of a lock target portion.
Figure 8C:
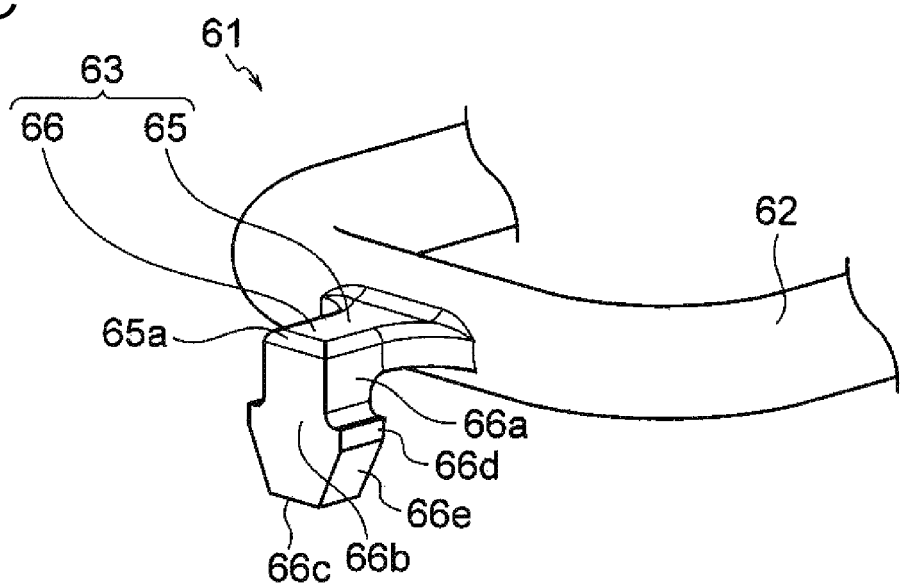
FIG. 8C is a perspective view of the lock target portion.

A second embodiment of the invention will be hereinafter described with reference to the drawings. FIGS. 8A-8C are views of an O-ring 61 according to the second embodiment. FIGS. 9A and 9B to FIGS. 11A and 11B illustrate a process of locking of the O-ring shown in FIGS. 8A-8C. Constituent members having basically the same ones in the first embodiment will be given the same reference symbols as the latter and will not be described in detail.

<O-Ring 61>

As shown in FIGS. 8A-8C and FIGS. 9A and 9B, the O-ring 61 according to the second embodiment has a structure that is effective in preventing itself from coming off though it is a little more complex in appearance than the structure of the O-ring 24 according to the first embodiment. The O-ring 61, which is elastic, serves to ensure necessary waterproofness between the insertion hole WH (see FIG. 6) which penetrates through the wall W and the housing 23 (in other words, necessary waterproofness between the wall W and the housing 23). The O-ring 61 has an O-ring main body 62 and a pair of lock target portions 63 for preventing the O-ring 61 itself from coming off, and is shaped as shown in these figures.

<O-Ring Main Body 62>

As shown in FIGS. 8A and 8B to FIGS. 11A and 11B, the O-ring main body 62 assumes an approximately rectangular ring shape in a plan view and is circular in cross section. The O-ring main body 62 is to be housed in the O-ring housing portion 45 of the housing 23.

<Pair of Lock Target Portions 62>

As shown in FIGS. 8A and 8B to FIGS. 11A and 11B, the pair of lock target portions 62 are continuous with the O-ring main body 62 from outside. The pair of O-ring lock portions 46 (see FIG. 4) of the housing 23 are to be locked on the pair of lock target portions 62, respectively.

The pair of lock target portions 62 have the same shape and hence one of them will be described below. Each lock target portion 62 has a connection portion 65 and a lock target portion main body 66 and is shaped as shown in FIGS. 8A-8C.

<Connection Portion 65>

As shown in FIGS. 8A and 8B to FIGS. 11A and 11B, the connection portion 65 is continuous with the O-ring main body 62 at one end and with the lock target portion main body 66 at the other end. That is, the connection portion 65 is a short arm-shaped portion which connects the O-ring main body 62 and the lock target portion main body 66. The connection portion 65 is formed in such a manner that the position of an imaginary line X1 is located above the center line X2 of the O-ring main body 62 (as viewed in FIG. 8B) and has a height H from the position of an imaginary line X3 which is the bottom position (the position of contact at the time of attachment) of the O-ring main body 62. The height H will be described later.

<Lock Target Portion Main Body 66>

As shown in FIGS. 8A and 8B to FIGS. 11A and 11B, the lock target portion main body 66 is a portion on which the associated O-ring lock portion 46 of the housing 23 is to be locked. The lock target portion main body 66 has a base portion 66*a* which is continuous with the other end of the connection portion 65, an intermediate portion 66*b* which is continuous with the base portion 66*a*, and a tip portion 66*c* which is continuous with the intermediate portion 66*b*, and is formed so as to extend perpendicularly to the extension direction of the connection portion 65 (i.e., the extension direction of the imaginary line X1). In other words, the lock target portion main body 66 is formed so as to extend straightly downward in FIG. 8B.

The intermediate portion 66*b* of the lock target portion main body 66 is formed with a pair of lock projections 66*d* which serve as portions on which respective lock step portions 46*c* are to be locked. A taper 66*e* is formed from each of the pair of lock projections 66*d* to the tip portion 46*c*. The pair of tapers 66*e* serve as guide target portions for the O-ring lock portion 46.

<Process from Tentative Setting to After Locking>

Referring to FIGS. 8A and 8B to FIGS. 11A and 11B, a description will now be made of a process from tentative setting of each lock target portion main body 66 to the associated O-ring lock portion 46 to after locking between them (in other words, until the O-ring 61 according to the second embodiment is rendered in a state that it does not come off, for example, during transport of the terminal block 21).

In the following description, reference numeral 67 denotes an O-ring attachment jig. The O-ring attachment jig 67 is a jig for attaching the O-ring 61 according to the second embodiment to the O-ring housing portion 45 and the O-ring lock portions 46. It is assumed that the O-ring attachment jig 67 works in such a manner as to be in the same positional relationship with the housing 23 as the wall W is (and hence the positional relationship does not change even if it is replaced by the wall W).

Figure 10B:
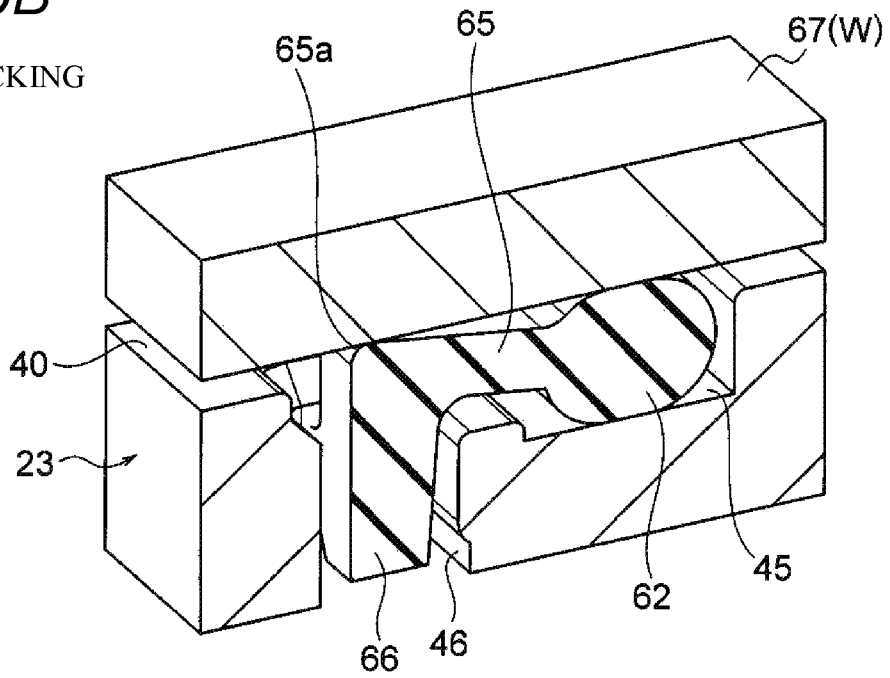
Figure 11A:
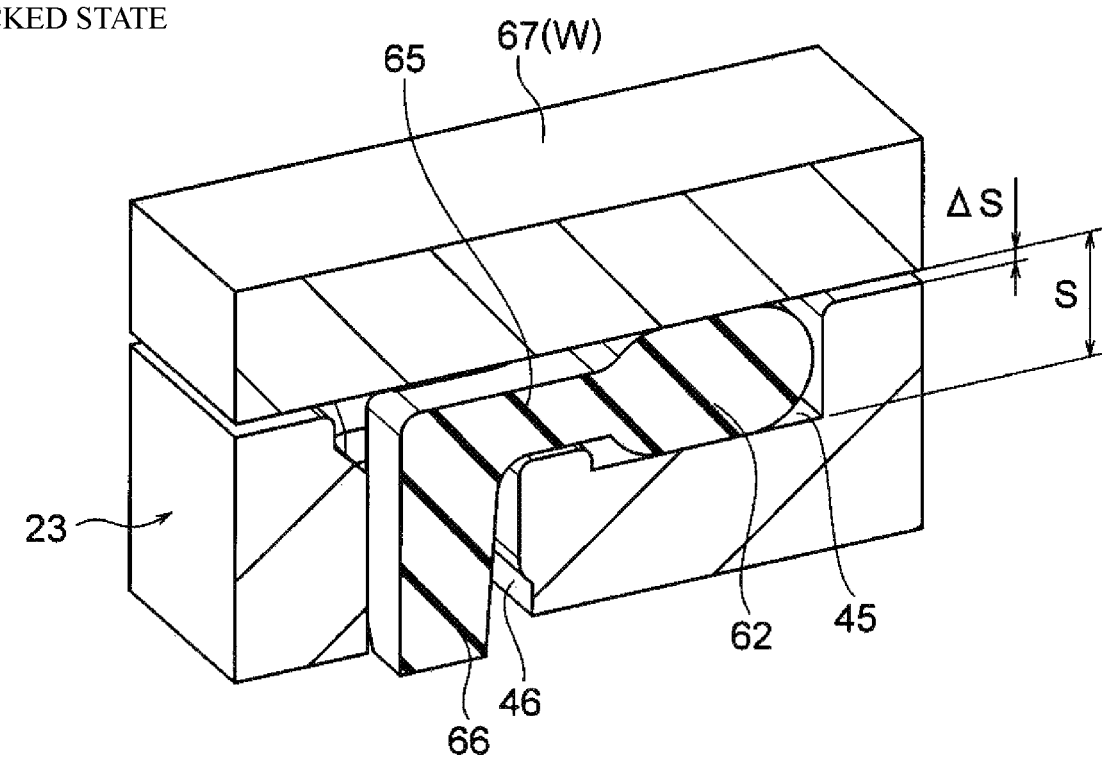
FIGS. 11A and 11B are a third set of figures illustrating the process of locking of the O-ring shown in FIGS. 8A-8C.

As shown in FIG. 11A, an interval S is defined as a dimension from the bottom of the O-ring housing portion 45 to the O-ring attachment jig 67 (wall W). The interval S is employed to describe how the connection portion 65 having the height H is disposed; it is assumed that the connection portion 65 is disposed so as to satisfy a relationship H S. As shown in FIG. 10B, a shoulder portion, located at its other end, of the connection portion 65 is denoted by reference symbol 65*a*.

Figure 9A:
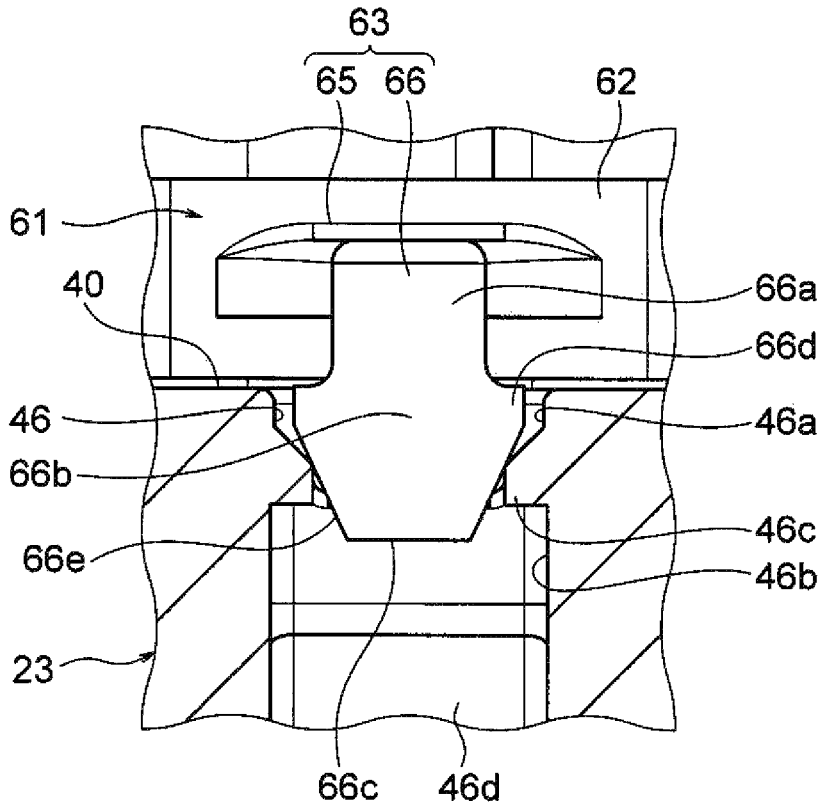
FIGS. 9A and 9B are a first set of figures illustrating a process of locking of the O-ring shown in FIGS. 8A-8C.
Figure 10A:
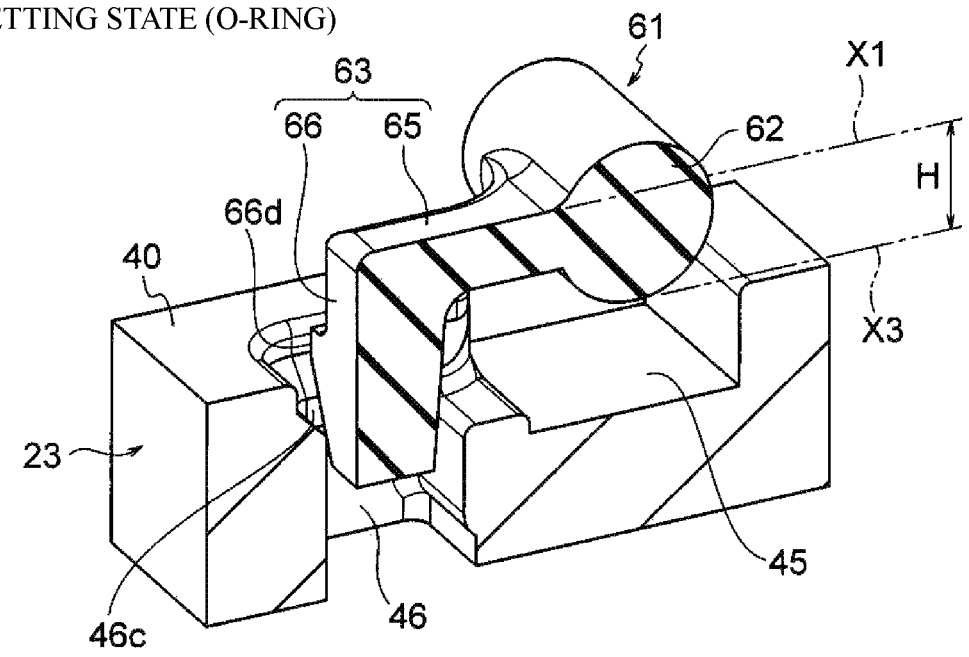
FIGS. 10A and 10B are a second set of figures illustrating the process of locking of the O-ring shown in FIGS. 8A-8C.

FIGS. 9A and 10A show a tentative setting state. The tentative setting state is an initial state before attachment of the O-ring 61 to the O-ring housing portion 45 and the O-ring lock portions 46. The tentative setting state is a state that the O-ring 61 is merely put on the housing 23.

The tentative setting state is a state before the lock projections 66*d* of the lock target portion main body 66 pass through the respective lock step portions 46*c* of the associated O-ring lock portion 46. Thus, more than half of the lock target portion main body 66 projects from the bottom wall 40 of the housing main body 34. Since the connection portion 65 projects perpendicularly from the lock target portion main body 66, the O-ring main body 62 which is continuous with the connection portion 65 is located over the O-ring housing portion 45. In the tentative setting state, the O-ring 61 is in such a state as to come off easily.

FIG. 10B shows a state before locking. This state is a halfway state of attachment of the O-ring 61 to the O-ring housing portion 45 and the O-ring lock portions 46 and is also a state that the O-ring 61 has started to be pressed by the O-ring attachment jig 67. When the O-ring 61 has started to be pressed by the O-ring attachment jig 67, first the O-ring main body 62 is moved downward in FIG. 10B and the bottom surface (corresponding to the term "attachment contact surface" used in the claims) of the O-ring main body 62 comes into contact with the bottom surface of the O-ring housing portion 45. When the O-ring 61 is pressed further by the O-ring attachment jig 67, the O-ring main body 62 is deformed elastically and crushed from a circular shape to an approximately elliptical shape (in cross section).

As the O-ring main body 62 is crushed, the connection portion 65 is inclined and the O-ring attachment jig 67 comes into contact with the shoulder portion 65*a* which is located at the other end of the connection portion 65. The shoulder portion 65*a* is thereafter pressed by the O-ring attachment jig 67 together with the O-ring main body 62. (Since the connection portion 65 is disposed so as to satisfy the relationship H (height)≥S (interval), the shoulder portion 65*a* is pressed surely by the O-ring attachment jig 67.) When the shoulder portion 65*a* is pressed by the O-ring attachment jig 67, a compressive force acts on the lock target portion main body 66 which is located right under the shoulder portion 65*a*.

Figure 9B:
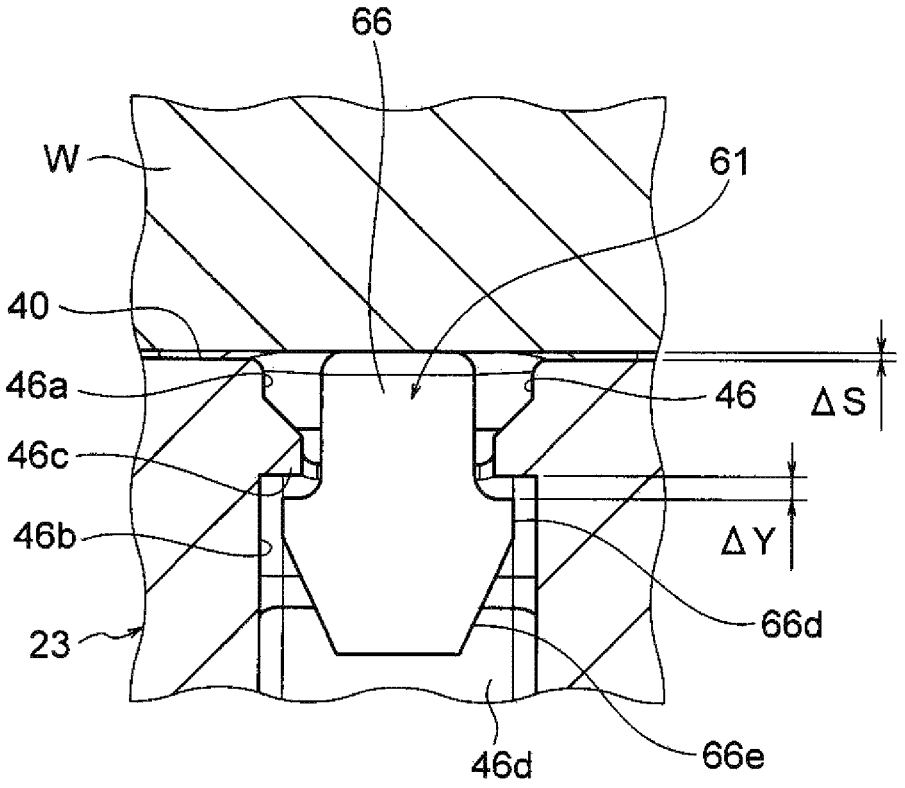

FIGS. 9B and 11A show a locked state. The locked state is a final state of attachment of the O-ring 61 to the O-ring housing portion 45 and the O-ring lock portions 46, and is also a state that the associated O-ring lock portion 46 has been locked on the lock target portion main body 66. In the locked state, the lock projections 66*d* of the lock target portion main body 66 have been deformed elastically by a compressive force acting on the lock target portion main body 66 and have passed the respective lock step portions 46*c* of the associated O-ring lock portion 46. The state of FIGS. 9B and 11A is a state that the lock target portion main body 66 has returned elastically to their original states.

When the lock target portion main body 66 has returned to their original states, they come to be located under the respective lock step portions 46*c* (see FIG. 9B). Even if a force acts on the lock target portion main body 66 in such a direction as to pull it out of the O-ring lock portion 46, it is not pulled out because it is blocked by the lock step portions 46*c*. The O-ring lock portion 46 is thus locked on the lock target portion main body 66. In the locked state, replace the O-ring attachment jig 67 with the wall W; then it is seen that waterproofness is established between the wall W and the housing 23 by the elastically deformed O-ring main body 62.

In this embodiment, as seen from FIG. 9B, a very small gap ΔS is formed between the wall W and the housing 23.

Figure 11B:
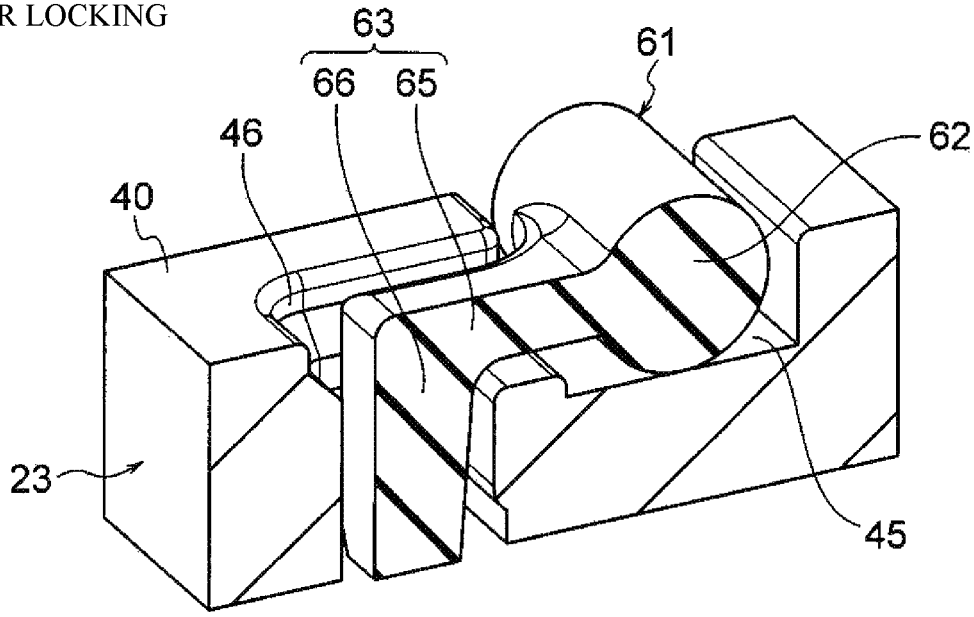
Figure 12:
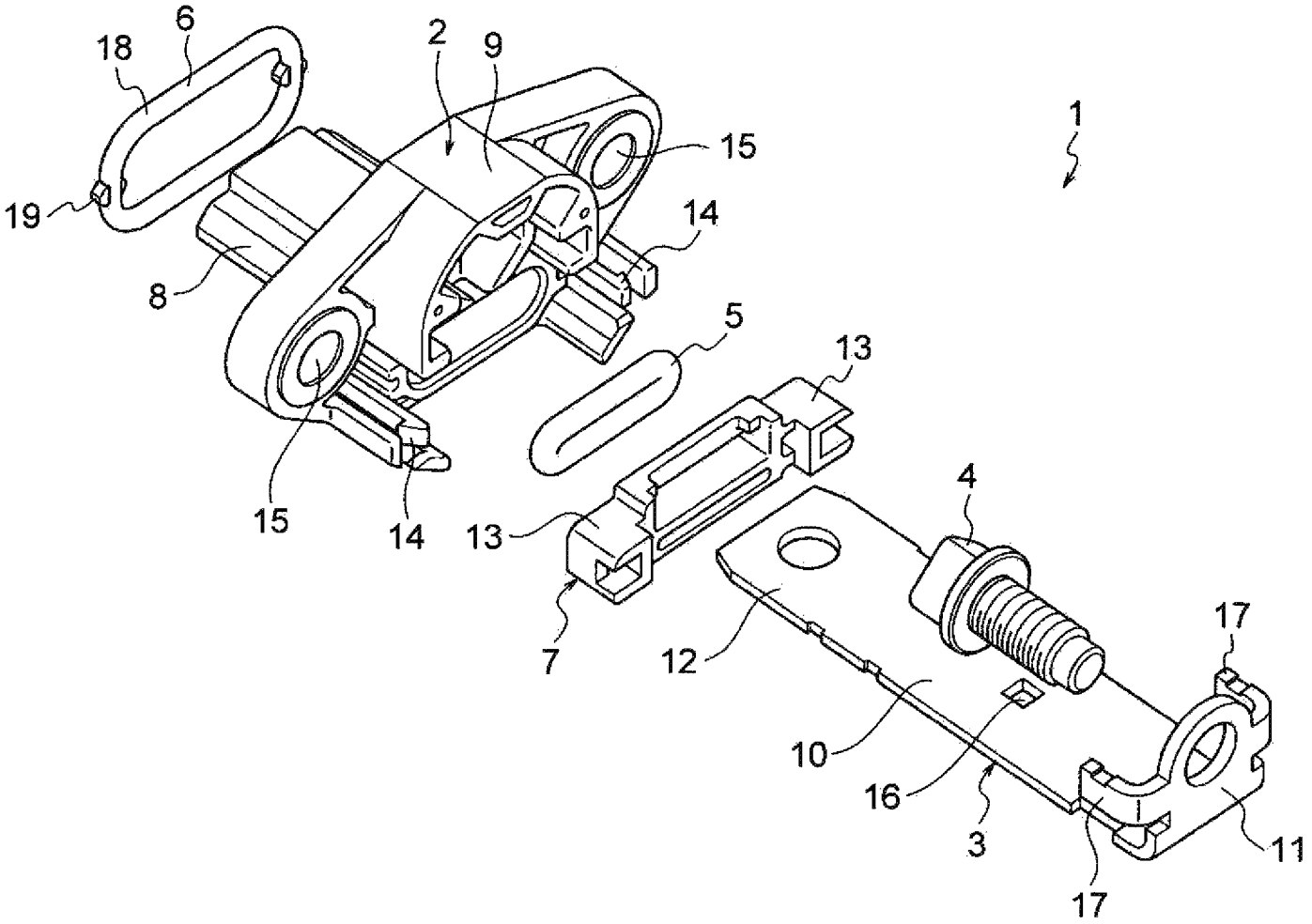
FIG. 12 is an exploded perspective view of a conventional terminal block.
Figure 13:
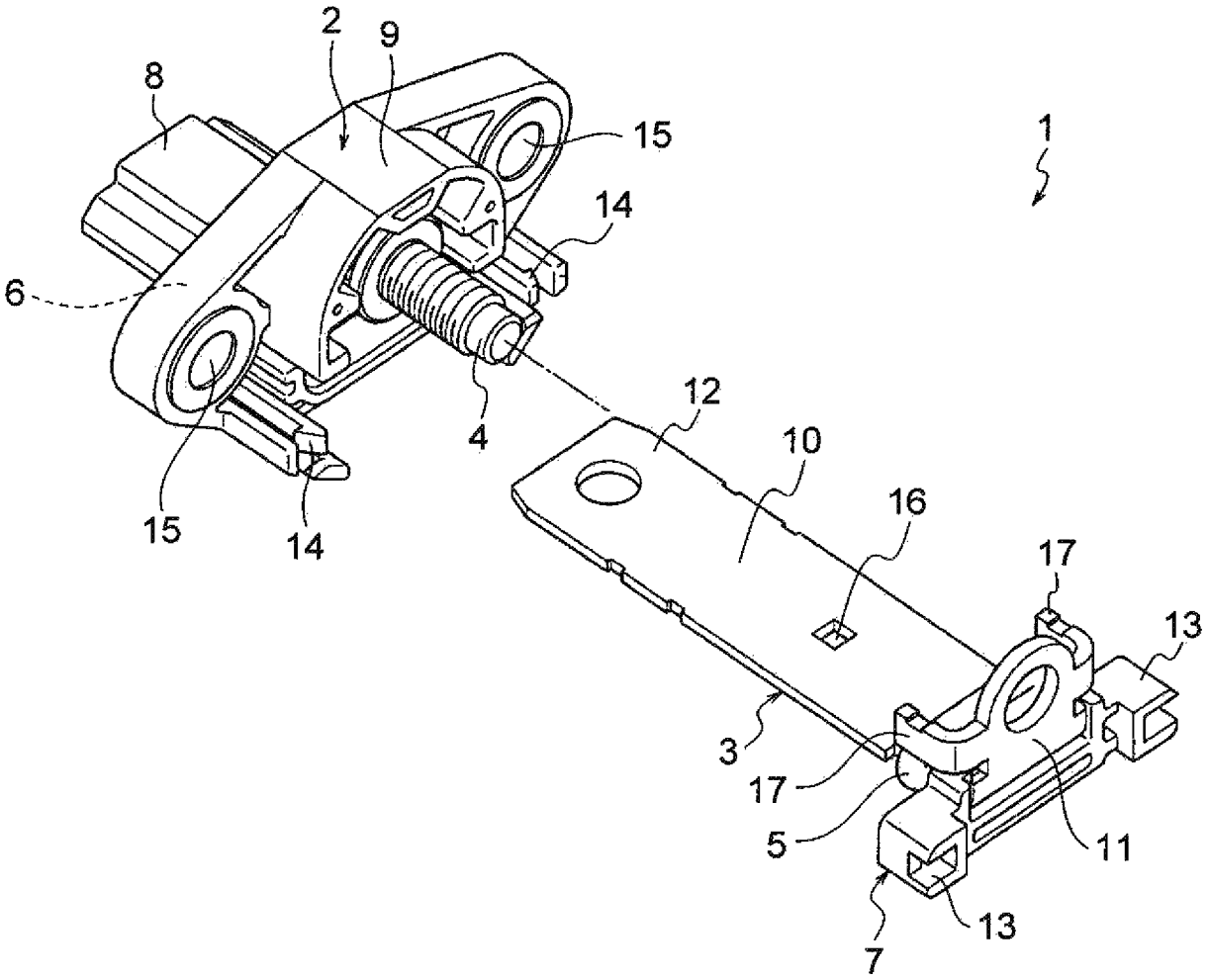
FIG. 13 is a perspective view of the conventional terminal block and shows a state that a busbar, a holder, and an O-ring are assembled together.

FIG. 11B shows a state that occurs after the locking. This is a state that the O-ring 61 has been attached to the O-ring housing unit 45 and the O-ring lock portion 46, and is a state that the O-ring 61 does not come off, for example, during transport of the terminal block 21 because the O-ring lock portions 46 are locked on the respective lock target portion main bodies 66.

As for the state that the O-ring 61 is prevented from coming off, it is effective that as shown in FIG. 9B the very small gap ΔS and the interval ΔY between the lock projections 66*d* and the respective lock step portions 46*c* satisfy a relationship ΔS<ΔY. As long as the relationship ΔS<ΔY is satisfied, the lock step portions 46*c* are locked on the lock projections 66*d* reliably and what is called half fitting does not occur.

(Advantages of O-Ring 61>

As described above with reference to FIGS. 8A-8C to FIGS. 11A and 11B, the O-ring 61 according to the second embodiment provides an advantage that it is prevented from coming off though being simple in structure.

It goes without saying that various modifications are possible without departing from the spirit and scope of the invention.

What is claimed is:

1. An O-ring comprising:

a ring-shaped O-ring main body; and a lock target portion which is continuous with the O-ring main body and is locked on an attachment counterpart, wherein the lock target portion has a connection portion which is continuous with the O-ring main body at one end, and a lock target portion main body which is continuous with another end of the connection portion and projects perpendicularly to an extension direction of the connection portion, and wherein the lock target portion main body has a hollow portion in a base portion which is continuous with the other end of the connection portion, and is formed in a tubular shape, and wherein the lock target portion is locked on the attachment counterpart such that the lock target portion main body is compressed inward to the hollow portion by compression.

2. The O-ring according to claim 1, wherein the base portion of the lock target portion main body is formed in a cylindrical tube, and a tip portion of the lock target portion main body has a ring-shaped taper.

3. The O-ring according to claim 1, wherein the connection portion is located at such a position with respect to the O-ring main body as to satisfy a relationship H≥S, where H is a pre-crushing height of the O-ring main body from an attachment contact surface, located on the side of contact to the attachment counterpart, of the O-ring main body to an outside surface of the connection portion, and S is a post-crushing interval between the attachment counterpart and a wall surface opposed to the attachment counterpart.

4. The O-ring according to claim 1, wherein the O-ring has such a shape that a parting line of a die for molding the O-ring extends along the extension direction of the connection portion beside the connection portion.

5. An O-ring lock structure comprising:

the O-ring according to claim 1; and an attachment counterpart to which the O-ring is attached, wherein the attachment counterpart has an O-ring housing portion which houses the O-ring main body of the O-ring, and a O-ring lock portion which is locked on the lock target portion of the O-ring; and wherein the O-ring lock portion is formed so as to constrict the lock target portion main body of the lock target portion.

6. A terminal block comprising:

the O-ring according to claim 1;

a housing as an attachment counterpart of the O-ring; and a busbar which is housed in the housing and serves for electrical connection, wherein the O-ring is locked on the housing so as to be located between the housing and a wall of an attachment destination of the housing.

7. The terminal block according to claim 6, wherein the O-ring is shaped so that the connection portion of the lock target portion of the O-ring comes into contact with the wall of the attachment destination or an O-ring attachment jig.

8. A vehicular device mounted on a vehicle comprising:

a device main body;

a device box which houses the device main body;

the terminal block according to claim 6 which is attached to a wall of the device box; and a wire harness which is electrically connected to the device main body via the terminal block.

9. The O-ring according to claim 1, wherein an opening to the hollow portion is expanded by a compression from the attachment counterpart on which the lock target portion is locked.

* * * * *